US008511115B2

(12) United States Patent
Kim et al.

(10) Patent No.: US 8,511,115 B2
(45) Date of Patent: Aug. 20, 2013

(54) WASHING MACHINE

(75) Inventors: Dongyoon Kim, Changwon-si (KR); Soojin Kim, Changwon-si (KR); Youngbae Park, Changwon-si (KR); Dongmin Kim, Changwon-si (KR); Sunggi Hwang, Changwon-si (KR); Seogkyu Park, Changwon-si (KR); Jongdeuk Bae, Changwon-si (KR); Seongno Yoon, Changwon-si (KR); Younggon Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 311 days.

(21) Appl. No.: 12/846,171

(22) Filed: Jul. 29, 2010

(65) Prior Publication Data

US 2011/0089793 A1 Apr. 21, 2011

Related U.S. Application Data

(60) Provisional application No. 61/230,510, filed on Jul. 31, 2009, provisional application No. 61/230,590, filed on Jul. 31, 2009.

(30) Foreign Application Priority Data

Jul. 31, 2009 (KR) ..... 10-2009-0071056
Jul. 31, 2009 (KR) ..... 10-2009-0071058
Feb. 26, 2010 (KR) ..... 10-2010-0017969

(51) Int. Cl.
*D06F 39/14* (2006.01)
*D06F 21/08* (2006.01)
*E05D 1/00* (2006.01)
*E05D 11/10* (2006.01)
*E05F 1/08* (2006.01)

(52) U.S. Cl.
USPC ..... 68/3 R; 68/196; 16/225; 16/295; 16/322

(58) Field of Classification Search
USPC ..... 68/3 R, 196; 16/225, 295, 322
See application file for complete search history.

(56) References Cited

U.S. PATENT DOCUMENTS

| | | | | |
|---|---|---|---|---|
| 3,118,167 | A * | 1/1964 | Morris et al. | 16/82 |
| 4,785,643 | A * | 11/1988 | Werner | 68/3 R |
| 4,787,121 | A * | 11/1988 | Racenis et al. | 16/356 |
| 6,282,927 | B1 * | 9/2001 | Wunderlich et al. | 68/3 R |
| 2004/0231370 | A1 * | 11/2004 | Cheo et al. | 68/3 R |
| 2006/0090523 | A1 * | 5/2006 | Lyu | 68/3 R |
| 2006/0254323 | A1 * | 11/2006 | Kim | 68/235 R |

* cited by examiner

*Primary Examiner* — Joseph L Perrin
*Assistant Examiner* — Levon J Shahinian
(74) *Attorney, Agent, or Firm* — Birch, Stewart, Kolasch & Birch, LLP

(57) ABSTRACT

A washing machine which includes a lid assembly opening/closing a laundry entrance hole, wherein the lid assembly includes a lid frame and a lid inner coupled to an inside of the lid frame and having a hinge unit, is provided. The lid assembly may be easily assembled and maintain a secure coupling, thereby allowing for a reliable and stable washing machine. Further, the lid assembly may be easily opened or closed by the hinge unit, and this increases convenience.

14 Claims, 15 Drawing Sheets

WASHING MACHINE

CROSS-REFERENCE TO RELATED APPLICATION

This application claims priority to Korean Patent Application No. 10-2009-0071056 filed on Jul. 31, 2009, and No. 10-2009-0071058 filed on Jul. 31, 2009, No. 10-2010-0017969 filed on Feb. 26, 2010 in the Korean Intellectual Property Office, and U.S. Provisional Patent Application No. 61/230,590 and 61/230,510 filed on Jul. 31, 2009 in the USPTO, the contents of which are herein incorporated by reference in its entirety.

BACKGROUND OF THE INVENTION

1. Technical Field

This disclosure is directed to a washing machine, and more specifically, to a washing machine with a lid assembly which may increase reliability, stability, and convenience of use.

2. Discussion of Related Art

In general, a washing machine may include a laundry washer which gets rid of contaminants from clothing or bedding (hereinafter, referred to as "laundry") using a chemical action between water and detergent and a mechanical action, and a dryer which dries wet laundry using air heated by a heater and a mechanical action. Also, a washing machine may have both a washing function and a drying function. Further, a washing machine may also include a refresher which sprays hot steam to laundry to prevent allergies. A washing machine may include various devices that exert physical or chemical actions to laundry to clean the laundry.

Washing machines may be categorized based on the location of a laundry entrance hole. For example, top load type washing machine have a laundry entrance hole at an upper surface of a cabinet and wash the laundry by a rotational water current generated when a washing tub rotates. Drum type washing machines have a laundry entrance hole at a front surface of a cabinet and wash the laundry by dropping the laundry in a drum while rotating the drum.

A lid assembly is arranged at an upper side of the cabinet of a top load type washing machine to open and close the laundry entrance hole.

SUMMARY OF THE INVENTION

Exemplary embodiments of the present invention provide a washing machine with a lid assembly which may increase stability, reliability, and convenience of use.

According to an embodiment, there is provided a washing machine comprising: a cabinet; a top cover arranged at an open top surface of the cabinet and has a laundry entrance hole; and a lid assembly disposed to be able to rotate at the top cover and opens/closes the laundry entrance hole, wherein the lid assembly includes a lid frame which forms the appearance and a lid inner coupled to an inside of the lid frame and has a hinge unit.

According to an embodiment, the lid frame includes an upper lid frame which forms an upper portion of the lid frame and supports the lid inner, and a lower lid frame coupled to a lower side of the upper lid frame.

According to an embodiment, the upper lid frame and the lower lid frame are coupled to each other by a connecting member in upper and lower directions.

According to an embodiment, the lid frame may have a lid inner inserting groove to which the lid inner is inserted.

According to an embodiment, a plurality of lid inners are provided that are spaced apart from each other by a predetermined interval, and wherein a plurality of hinge units are provided that are connected to neighboring lid inners of the plurality of lid inners.

According to an embodiment, the plurality of hinge units include a first hinge unit which adjusts a degree of rotation of the lid assembly when the lid assembly opens or closes, and a second hinge unit which adjusts rotation speed of the lid assembly when the lid assembly opens or closes.

According to an embodiment, the first hinge unit includes a hydraulic damper filled with a fluid and adjusts rotation speed by a fluid pressure, and the second hinge unit includes an elastic member which provides an elastic force in a direction which opens the lid assembly.

According to an embodiment, at least two or more lid inners having the hinge unit among the plurality of lid inners are arranged at a side of the lid frame, wherein each of the lid inners having the hinge unit are connected to the lid frame by a connecting member so that hinge axes of the hinge units connected to neighboring lid inners are in alignment with each other.

According to an embodiment, the plurality of lid inners include four lid inners which are spaced apart from each other, wherein each of the lid inners has a similar shape to that of a corner of the lid frame, wherein two lid inners are arranged at a side of the lid frame.

According to an embodiment, the plurality of hinge units include first and second hinge units which are arranged at the lid inners respectively, wherein the lid inners are connected to the lid frame by a connecting member so that a first hinge axis of the first hinge unit is in alignment with a second hinge axis of the second hinge unit.

According to an embodiment, the lid frame includes a gap press-fitting part protruded and is inserted into a gap between neighboring lid inners and pressurizes the lid inners in a direction away from each other, so that the lid inners are brought in tight contact with an inner surface of the lid frame.

According to an embodiment, the gap press-fitting part includes a plurality of ribs which protrude from the lid frame and are spaced apart from each other by a predetermined interval.

According to an embodiment, the lid frame includes a hinge cover extended and wraps around the hinge unit.

According to an embodiment, the hinge unit includes a housing inserted into the lid inner and wraps around a hinge shaft, and a connecting arm which protrudes from a side of the housing and fits into a side surface of the lid inner.

According to an embodiment, the lid inner, the connecting arm of the hinge unit, and the lid frame are arranged in an order thereof, and then integrally connected to each other by a connecting member.

According to an embodiment, each of the lid frame and the lid inner may be formed to have an opening at a central portion thereof, wherein a glass unit is arranged at the opening.

According to an embodiment, the lid inner further may include a glass guide rib which guides the positions of the glass unit.

According to an embodiment, a plurality of lid inners are provided, wherein the glass unit pressurizes the plurality of lid inners toward the lid frame so that the lid inners are brought in tight contact with the lid frame.

According to an embodiment, the washing machine may further comprise a handle which protrudes forwards more than the top cover so that a user's hand is inserted into a space between the lid frame and the top cover, wherein the user can hold the handle.

According to an embodiment, there is provided a washing machine comprising: a cabinet; a top cover arranged at an open top surface of the cabinet and has a laundry entrance hole; and a lid assembly disposed to be able to rotate at the top cover and opens/closes the laundry entrance hole, wherein the lid assembly includes a lid frame which forms the appearance, a plurality of lid inners which are spaced apart from each other by a predetermined interval inside the lid assembly, a plurality of hinge units connected to the lid inners and the lid frame, wherein a hinge unit is inserted into each of two neighboring lid inners among the plurality of lid inners, a glass unit coupled to the lid inner and pressurizes the lid inner toward the lid frame so that the lid inner is brought in tight contact with the lid frame, and a decoration panel coupled to a front and lower side of the lid frame.

The washing machine according to an embodiment of the present invention includes a lid assembly which opens/closes a laundry entrance hole, wherein the lid assembly includes a lid frame and a lid inner coupled to an inner portion of the lid frame and having a hinge unit. Thus, the washing machine may be easily and securely assembled, thereby allowing for a reliable, stable washing machine.

Further, the lid assembly may be easily opened and closed by the hinge unit. This may increase convenience of use.

Further, since the plurality of lid inners are arranged so that an end of a lid inner is spaced apart from an end of a neighboring lid inner, the lid inner may be prevented from colliding with each other even when the lid inners are deformed due to heat.

Further, the washing machine includes first and second hinge units wherein while the hinge axes of the first and second hinge units are arranged in alignment with each other, the two lid inners coupled with the first and second hinge units, respectively, are connected to the upper lid frame by a connecting member, such as a screw. Accordingly, the lid assembly may be prevented from being twisted when being opened or closed.

DETAILED DESCRIPTION

Hereinafter, exemplary embodiments of a top load type washing machine (hereinafter, referred to as "washing machine") will be described in greater detail with reference to the accompanying drawings.

Figure 1:
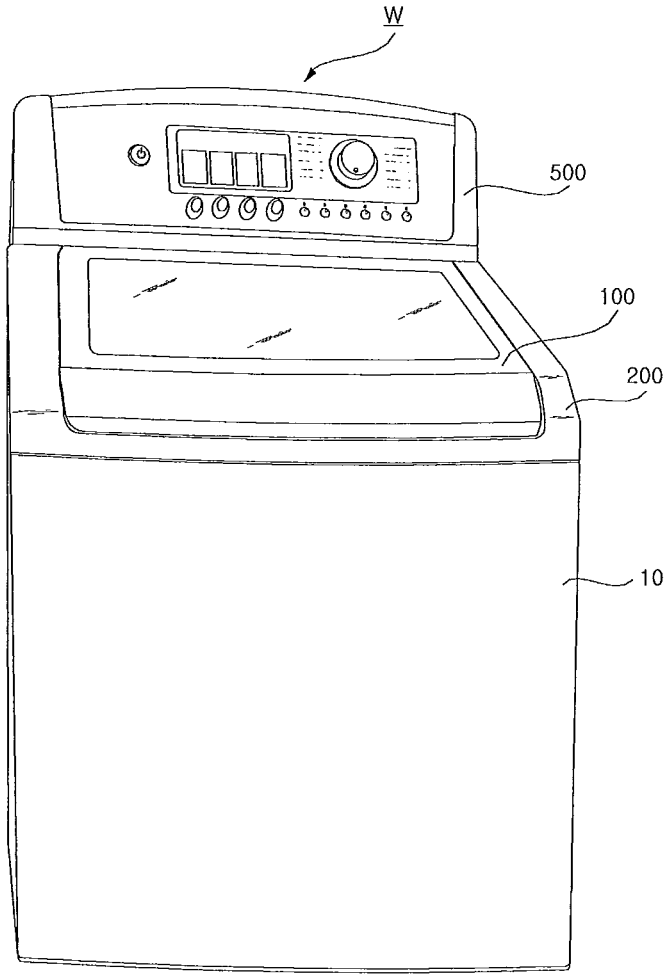
FIG. 1 is a perspective view illustrating a washing machine according to an embodiment of the present invention.
Figure 2:
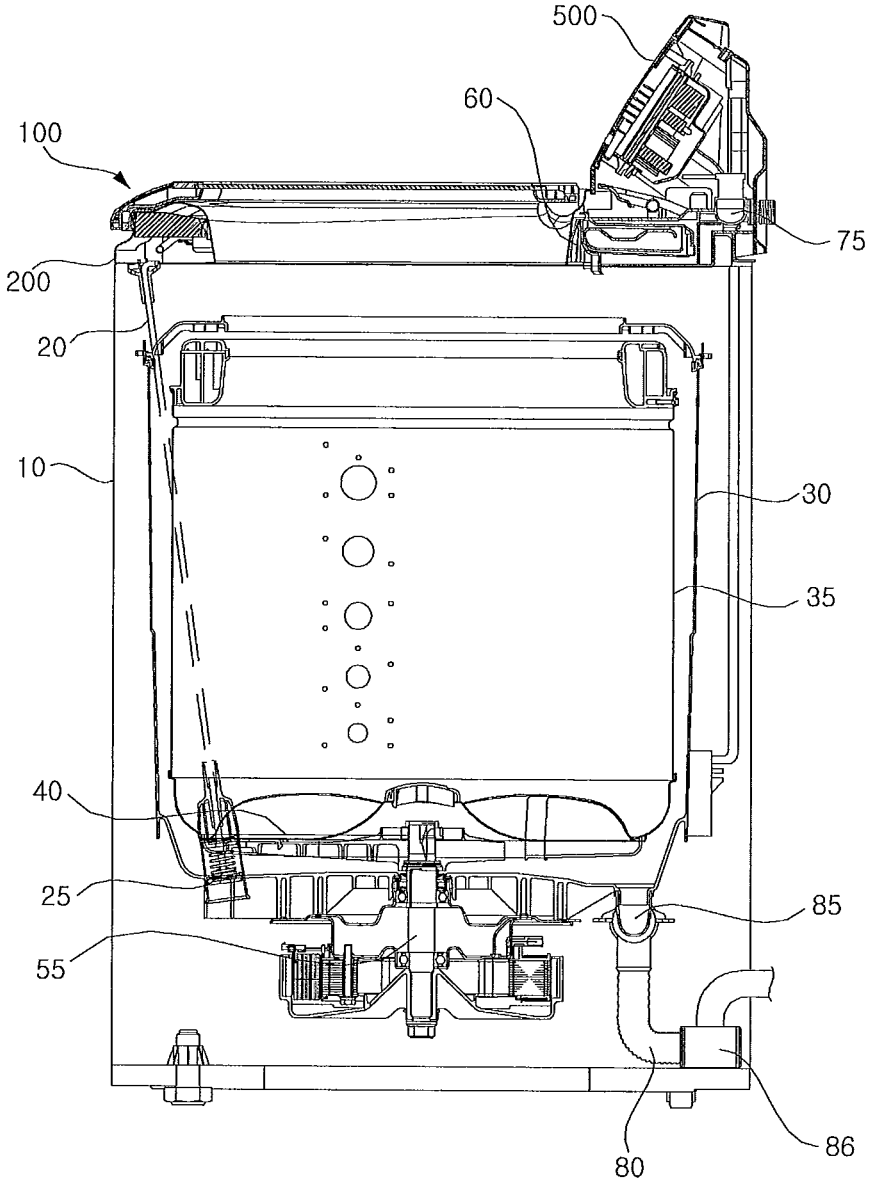
FIG. 2 is a cross sectional view of the washing machine shown in FIG. 1.

FIG. 1 is a perspective view illustrating a washing machine according to an embodiment of the present invention and FIG. 2 is a cross sectional view of the washing machine shown in FIG. 1.

Referring to FIGS. 1 and 2, the washing machine W includes a cabinet 10, a top cover 200, a lid assembly 100, and a control panel 500. The top cover 200 is arranged at an upper side of the cabinet 10 and includes a laundry entrance hole 211. The lid assembly 100 is connected to be able to rotate to the top cover 200 to open and close the laundry entrance hole 211. The control panel 500 allows a user to control the washing machine W.

Referring to FIG. 2, an outer tub 30 is supported by a support member 20 inside the cabinet 10. An inner tub 35 for containing laundry is disposed to be able to rotate inside the outer tub 30.

An upper end of the support member 20 is connected to the top cover 200 or an upper side of the cabinet 10. A damper 25 connected to a lower portion of the outer tub 30 is provided at a lower end of the support member 20.

A plurality of pores is provided along the circumferential surface of the inner tub 35. A pulsator 40 is positioned at the bottom surface of the inner tub 35 to generate a rotational water flow.

A motor 55 is positioned at a lower portion of the outer tub 30 to rotate the inner tub 35 and the pulsator 40. The motor 55 is connected to the inner tub 35 via a rotational shaft to rotate the inner tub 35. A clutch (not shown) is positioned between the inner tub 35 and the pulsator 40 to selectively transfer a rotational force to at least one of the inner tub 35 and the pulsator 40. By the clutch, either or both of the inner tub 35 and the pulsator 40 may be rotated.

A detergent box is positioned at the top cover 200 to receive a detergent.

The washing machine W further includes a water supply hose 75 which guides water from an external tab (not shown) to the detergent box 60 and a water supply valve (not shown) which opens/closes washing water passing through the water supply hose 75.

The washing machine W further includes a drainage hose 80 connected to a lower portion of the outer tub 30 to guide washing water from the outer tub 30 to the outside, a drainage pump 86 which pumps washing water in the outer tub 30, and a drainage valve 85 which opens/closes washing water discharged through the drainage hose 80 to the outside.

Figure 3:
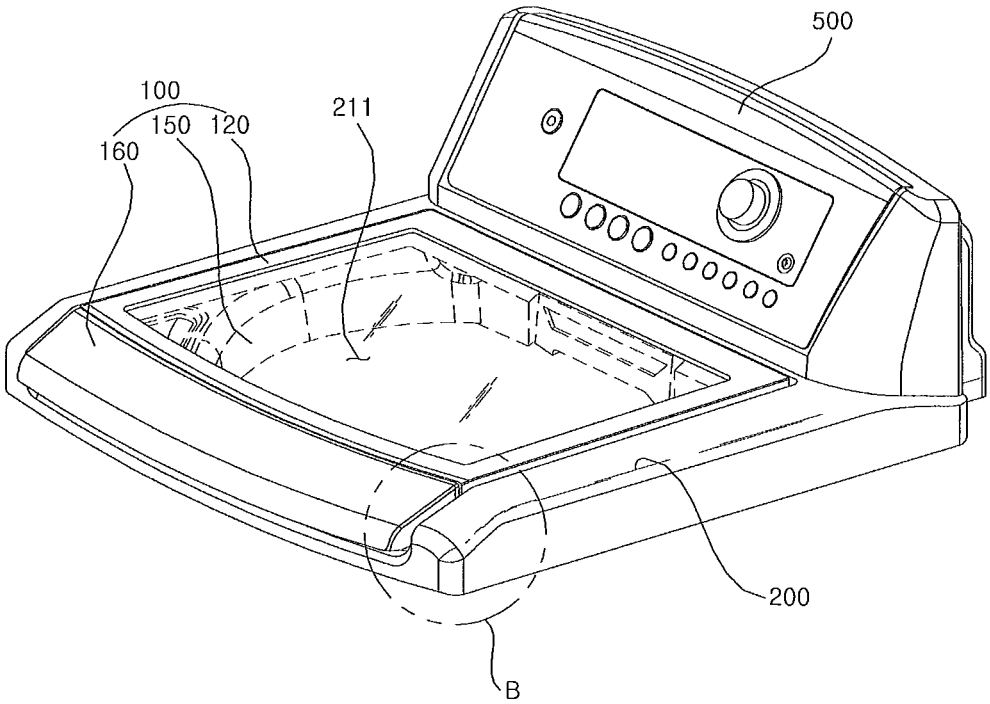
FIG. 3 is a perspective view illustrating the top cover and the lid assembly shown in FIG. 1.
Figure 4:
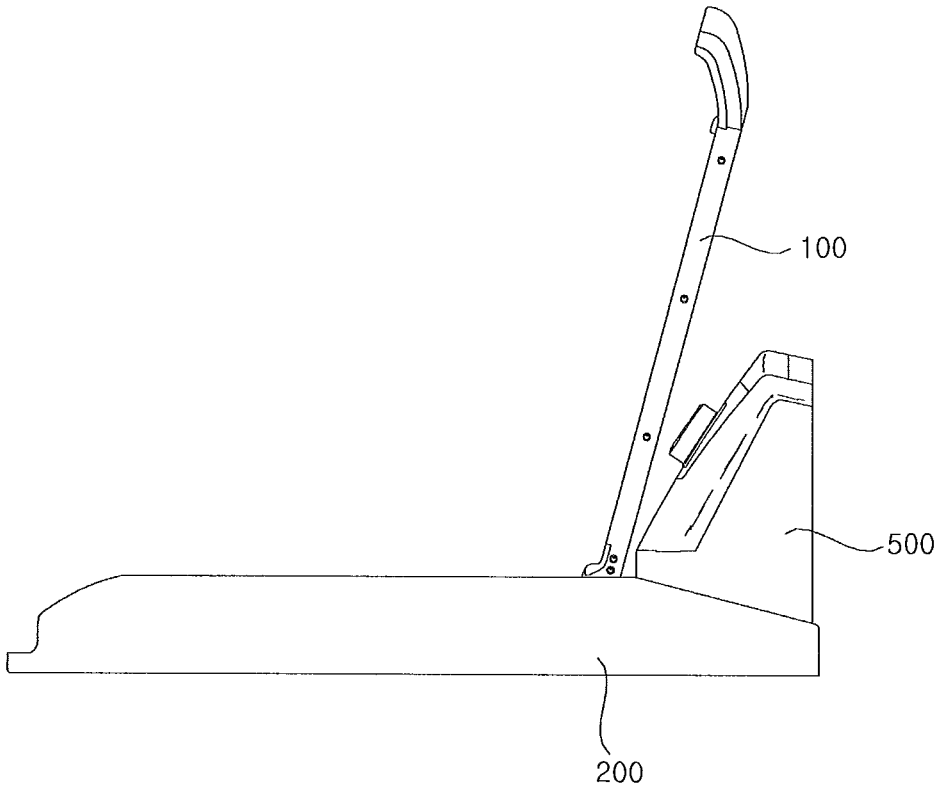
FIG. 4 is a side view of FIG. 3 wherein the lid assembly is left open.
Figure 5:
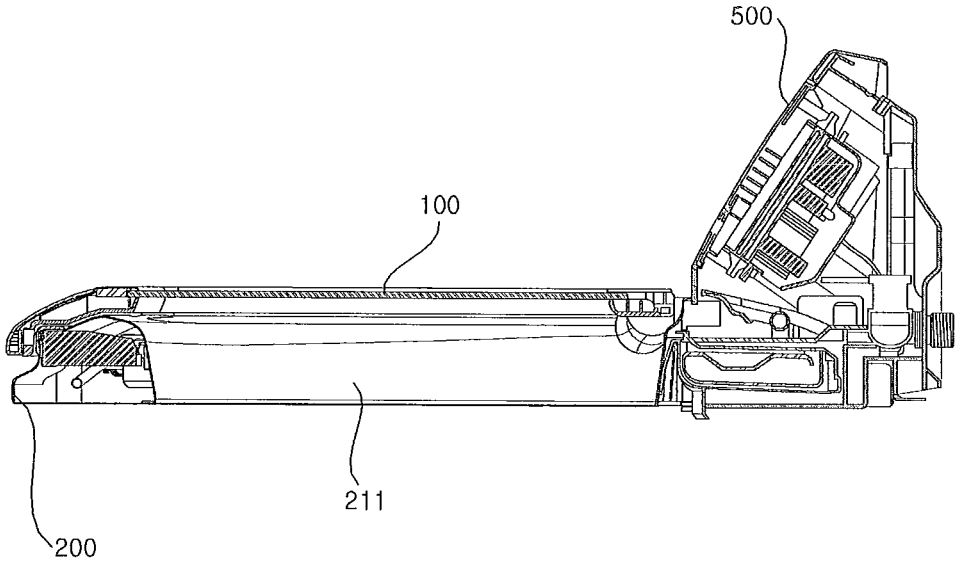
FIG. 5 is a cross sectional view of FIG. 3.

FIG. 3 is a perspective view illustrating the top cover and the lid assembly shown in FIG. 1, FIG. 4 is a side view of FIG. 3 wherein the lid assembly is left open, and FIG. 5 is a cross sectional view of FIG. 3.

Referring to FIGS. 3 to 5, the lid assembly 100 is connected to be able to rotate to the top cover 200 to open/close the laundry entrance hole 211. The lid assembly 100 may be connected to be able to rotate to the top cover 200 by a hinge unit 300 which will be described below.

Figure 6:
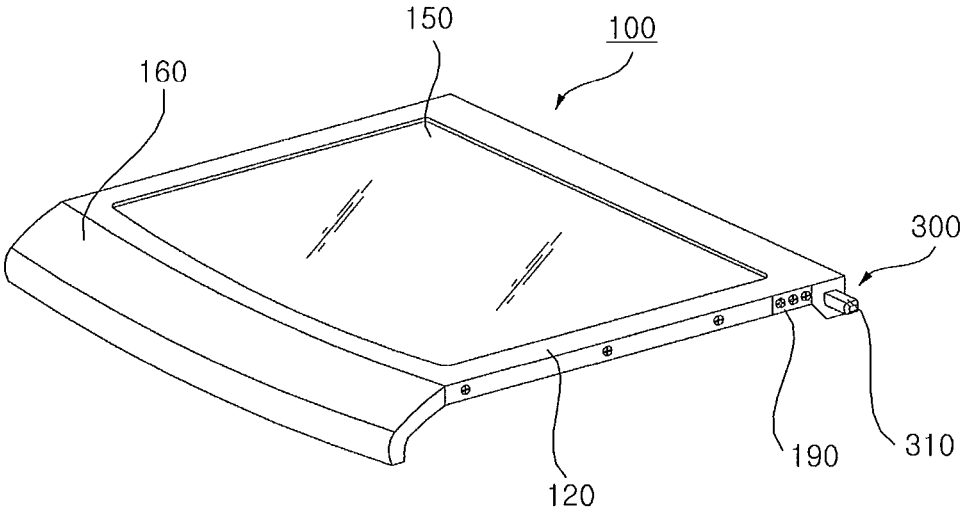
FIG. 6 is a perspective view illustrating the lid assembly shown in FIG. 3.
Figure 7:
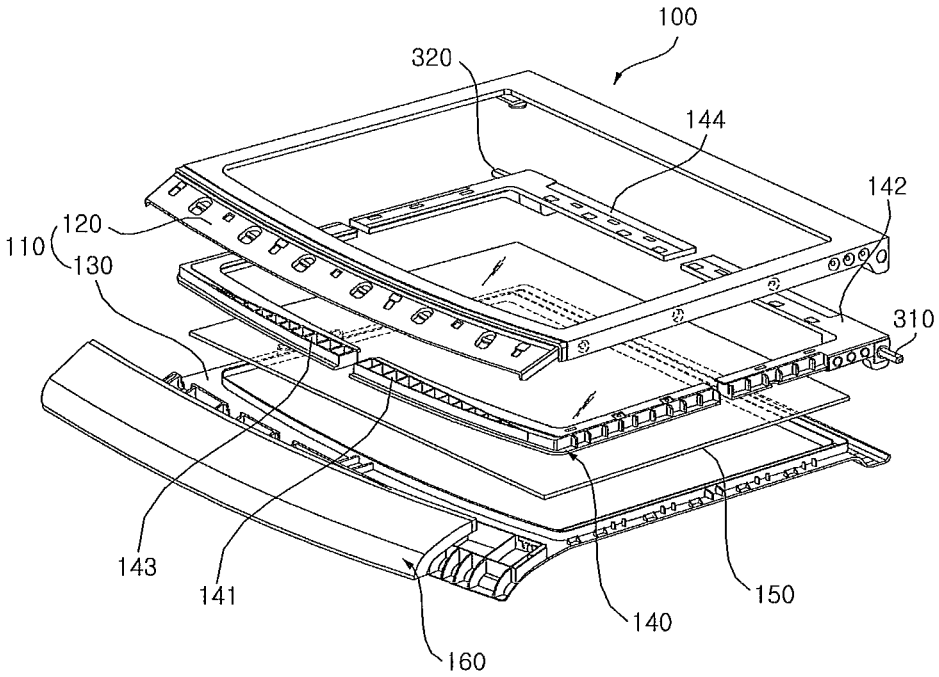
FIG. 7 is an exploded perspective view illustrating the lid assembly shown in FIG. 6.

FIG. 6 is a perspective view illustrating the lid assembly shown in FIG. 3 and FIG. 7 is an exploded perspective view illustrating the lid assembly shown in FIG. 6.

Referring to FIGS. 6 and 7, the lid assembly 100 includes a lid frame 110 which forms the appearance of the lid assembly 100, a lid inner 140 connected to the lid frame 110 at the inside of the lid frame 110 and has a hinge unit 300, a glass unit 150 positioned at a portion where the lid frame 110 and the lid inner 140 are open, and a decoration panel 160 connected to the lid frame 110 at a front portion of the lid frame 110.

Referring to FIG. 7, the lid frame 110 includes an upper lid frame 120 which forms the appearance of an upper portion of the lid frame 110 and a lower lid frame 130 which forms the appearance of a lower portion of the lid frame 110 and is connected to a lower side of the upper lid frame 120.

A plurality of lid inners 140 may be positioned to be spaced apart from each other by a predetermined interval. For purposes of brevity, it is assumed that four lid inners 140 are provided. However, the present invention is not limited thereto. For example, at least two or more lid inners 140 may be provided.

Each of the four lid inners 140 may have the similar shape to that of a corner of the lid frame 110. For example, each of the four lid inners 140 may be shaped as the symbol "┐". Two lid inners 140 are arranged at each side of the lid frame 110. For example, the lid inners 140 may include first, second, third, and fourth lid inners 141, 142, 143, and 144, wherein the first and third lid inners 141 and 143 may be arranged at a front side, and the second and fourth lid inners 142 and 144 may be arranged at a rear side. The hinge unit 300 may be coupled to each of the second and fourth lid inners 142 and 144.

At least one hinge unit 300 may be provided. For example, a plurality of hinge units may be provided so that one hinge unit may be coupled to each of a plurality of neighboring lid inners.

An embodiment will be described where the hinge unit 300 includes a first hinge unit 310 coupled to the second lid inner 142 and a second hinge unit 320 coupled to the fourth lid inner 144. The hinge unit 300 will be described in greater detail later.

Figure 8:
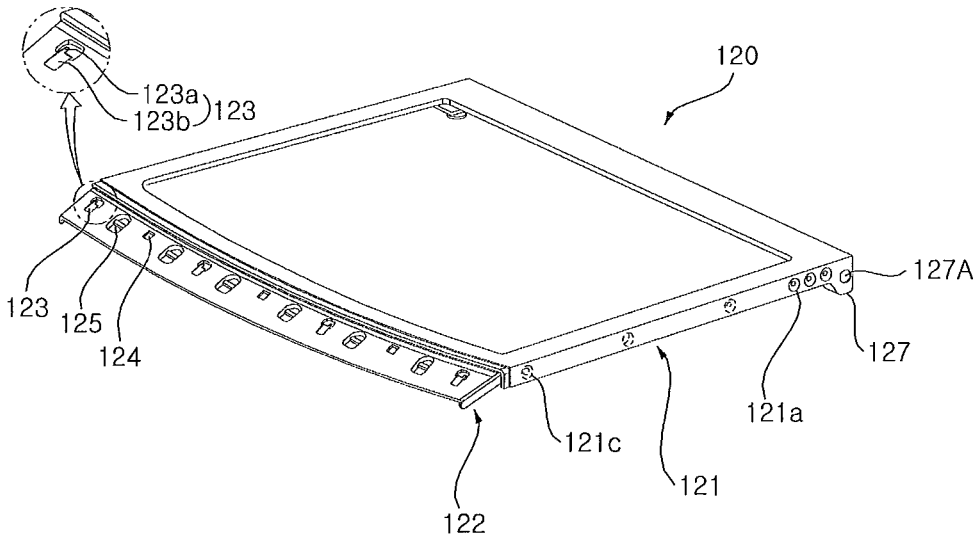
FIG. 8 is a perspective view illustrating an upper surface of the upper lid frame shown in FIG. 7.
Figure 9:
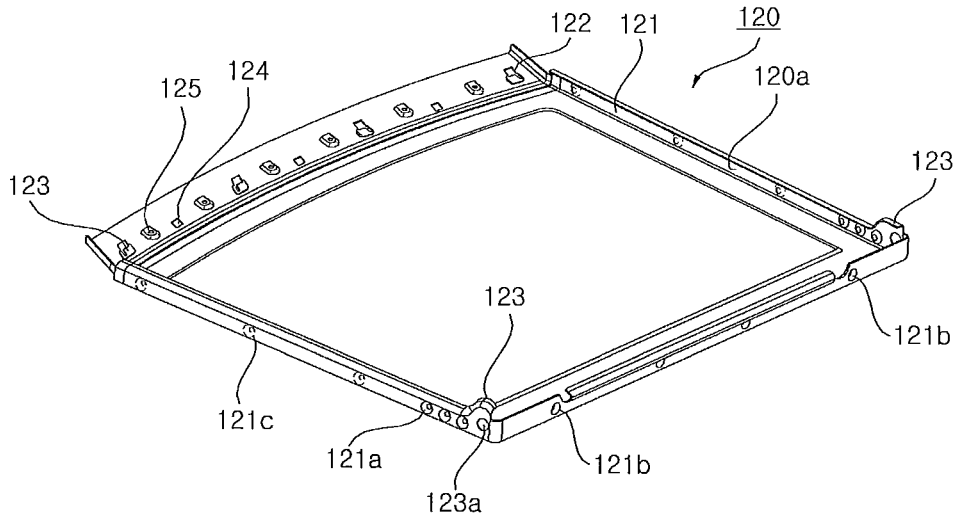
FIG. 9 is a perspective view illustrating a lower surface of the upper lid frame shown in FIG. 8.

FIG. 8 is a perspective view illustrating an upper surface of the upper lid frame shown in FIG. 7, and FIG. 9 is a perspective view illustrating a lower surface of the upper lid frame shown in FIG. 8.

Referring to FIGS. 8 and 9, the upper lid frame 120 has an opening at its central portion. The glass unit 150 is arranged at the opening.

The upper lid frame 120 includes a rectangular frame part 121 which has an opening at its central portion and a coupling part 122 which extends from a front end of the frame part 121 and is coupled to the lower lid frame 130.

The coupling part 122 of the upper lid frame 120 is formed to be inclined downwards from the front direction of the frame part 121 by a predetermined angle.

The decoration panel 160 is coupled to an upper side of the coupling part 122 of the upper lid frame 120, and the lower lid frame 130 is coupled to a lower side of the coupling part 122 of the upper lid frame 120.

Referring to FIG. 8, the coupling part 122 of the upper lid frame 120 includes a connecting protrusion coupling hole 123 to which a connecting protrusion 161 is connected, a guide protrusion coupling hole 124 to which a guide protrusion 162 is connected, and a screw connecting hole 125 connected to the lower lid frame 130 via a connecting member, such as a screw. The connecting protrusion 161 and the guide protrusion 162 are formed on the decoration panel 160. The connecting protrusion 161 and the guide protrusion 162 will be described below.

The guide protrusion 162 (refer to FIG. 16) is inserted into the guide protrusion coupling hole 124 in upper and lower directions to guide and position the decoration panel 160 upon assembly of the decoration panel 160. For example, the guide protrusion coupling hole 124 may be shaped to correspond to the shape of the guide protrusion 162 which will be described below.

The connecting protrusion 161 is connected by sliding after being inserted to the connection protrusion coupling hole 123, so that the decoration panel 160 can be connected by sliding to the coupling part 122 of the upper lid frame 120.

The connecting protrusion 161 which will be described below is formed in the shape of "┐". The connecting protrusion coupling hole 123 includes an inserting part 123*a* into which the connecting protrusion 161 is inserted and a connecting part 123*b* which extends from the inserting part 123*a* with a reduced width. The connecting protrusion 161 is connected to the connecting part 123*b*.

Since the decoration panel 160 is positioned over the coupling part 122 of the upper lid frame 120, the connecting protrusion coupling hole 123, the guide protrusion coupling hole 124, and the screw connecting hole 125 may be covered by the decoration panel 160.

The left and right side surfaces and the rear surface of the frame part 121 may be coupled to the lower lid frame 130. An embodiment will be described where each of the left and right side surfaces and rear surface of the frame part 121 is coupled via a connecting member, such as a screw, to the lower lid frame 130 connected with the hinge unit 300.

The frame part 121 of the upper lid frame 120, the hinge unit 300, and the lid inner 140 may be integrally connected to each other by a screw. The frame part 121 of the upper lid frame 120 and the lid inner 140 may be only connected to each other by a screw. A side screw coupling hole 121*a* is formed at each of the left and right side surfaces of the frame part 121 to for screw connection. A plurality of side screw coupling holes 121*a* may be provided. The side screw coupling hole 121*a* may be positioned at a location close to the hinge unit 300. However, the present invention is not limited thereto. For example, the side screw coupling hole 121*a* may be omitted.

Referring to FIG. 9, a rear screw coupling hole 121*b* is provided at the rear surface of the frame part 121 for screw connection. Two rear screw coupling holes 121*b* may be provided, each of which may be positioned at a location close to the hinge unit 300. Because of being positioned at a location where the hinge unit 300 is connected, the side screw coupling hole 121*a* and the rear screw coupling hole 121*b* may effectively support the hinge unit 300.

Each of the left and right side surfaces of the upper lid frame 120 may be connected to the lid inner 140 via a connecting member, such as a screw. The screw connecting hole 121*c* may be formed at the left and right side surfaces of the upper lid frame 120.

Referring to FIGS. 8 and 9, the upper lid frame 120 includes a hinge cover 127 which covers the hinge unit 300.

The hinge cover 127 is extended downwards from each of the left and right side surfaces of the upper lid frame 120. The hinge cover 127 has a through-hole 127*a* for the hinge shaft of the hinge unit 300 to pass therethrough.

Referring to FIG. 9, a lid inner inserting groove 120*a* is formed at each of the left and right side surfaces of the upper lid frame 120 so that the lid inner 140 may be seated on the lid inner inserting groove 120*a*. The lid inner inserting groove 120*a* may have a cross section shaped as the symbol "[".

The upper lid frame 120 may be made of a metallic material or an elastic material. An embodiment will be described where the upper lid frame 120 is made of steel with rigidity.

Figure 10:
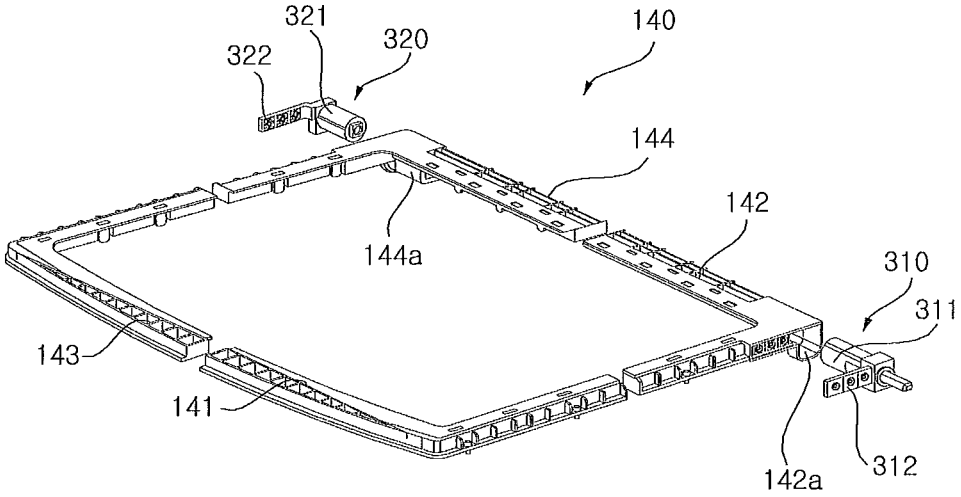
FIG. 10 is an exploded perspective view illustrating lid inners and hinge units which are dissembled from each other.
Figure 11:
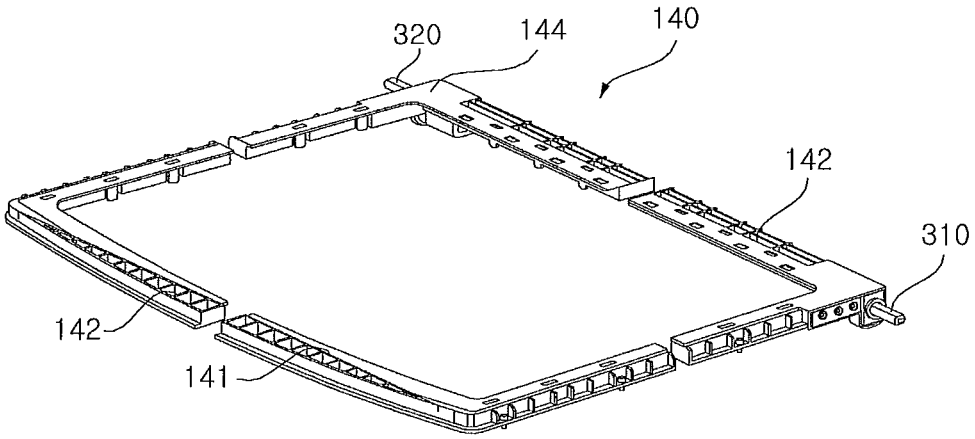
FIG. 11 is a perspective view illustrating lid inners and hinge units which are assembled to each other.
Figure 12:
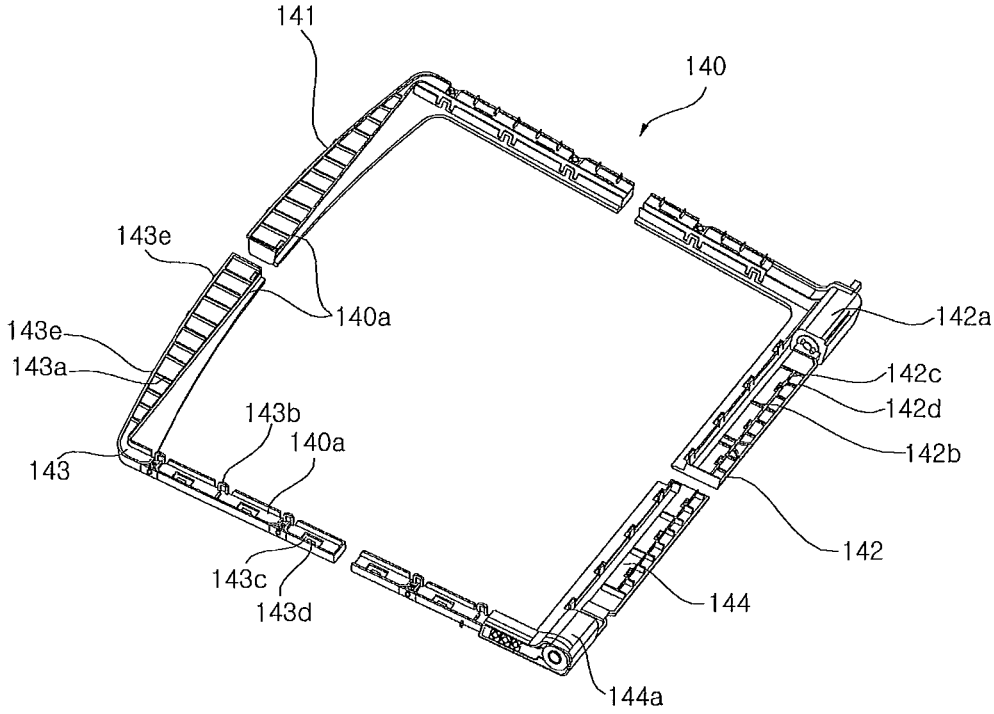
FIG. 12 is a perspective view illustrating a bottom surface of the lid inners shown in FIG. 11.

FIG. 10 is an exploded perspective view illustrating lid inners and hinge units which are dissembled from each other, FIG. 11 is a perspective view illustrating lid inners and hinge units which are assembled to each other, and FIG. 12 is a perspective view illustrating a bottom surface of the lid inners shown in FIG. 11.

As described above, the plurality of lid inners 140 include the first and third lid inners 141 and 143 positioned at a front side and the second and fourth lid inners 142 and 144 positioned at a rear side and having the hinge unit 300.

Each of the first, second, third, and fourth lid inners 141, 142, 143, and 144 is shaped as the symbol "┐". and positioned near a corner. Further, the first, second, third, and fourth lid inners 141, 142, 143, and 144 are spaced apart from each other by a predetermined interval. Specifically, an end of each of the first, second, third, and fourth lid inners 141, 142, 143, and 144 is spaced apart from an end of a neighboring lid inner of the first, second, third, and fourth lid inners 141, 142, 143, and 144. This prevents the lid inners from colliding with each other even when the lid inners are deformed due to heat.

The second lid inner 142 includes a first hinge unit receiving part 142*a* to which the first hinge unit 310 is inserted.

The fourth lid inner 144 includes a second hinge unit receiving part 144*a* to which the second hinge unit 320 is inserted.

Although the first and second hinge unit receiving parts 142*a* and 144*a* are described to be provided in the second and fourth lid inners 142 and 144, the present invention is not limited thereto. For example, the first and second hinge unit receiving parts 142*a* and 144*a* may also be formed by coupling the second and fourth lid inners 142 and 144 with the lower lid frame 130.

The first and second hinge units 310 and 320 are inserted in the axial direction into the first and second hinge unit receiving parts 142*a* and 144*a*, respectively.

The first and second hinge units 310 and 320 include hinge housings 311 and 321, respectively, and connecting arms 312 and 322, respectively. The hinge housings 311 and 321 are inserted to the second and fourth lid inners 142 and 144, respectively, and wrap around the hinge shaft. The connecting arms 312 and 322 protrude from side surfaces of the hinge housings 311 and 321, respectively, and fit into side surfaces of the second and fourth lid inners 142 and 144, respectively.

The connecting arms 312 and 322 of the first and second hinge units 310 and 320 may be integrally connected to the lid inner 140 and the lid frame 110, or may be connected only to the lid inner 140.

The first and second hinge units 310 and 320 may have the same or different functions. An embodiment will be described where the first hinge unit 310 adjusts the degree of rotation of the lid assembly 100 when the lid assembly 100 is opened or closed and the second hinge unit 320 reduces the rotation speed of the lid assembly 100 when the lid assembly 100 is opened or closed to alleviate shock.

For example, the first hinge unit 310 may include a hydraulic damper filled with a fluid to adjust the rotation speed by fluid pressure.

The second hinge unit 320 includes an elastic member which provides an elastic force in the direction which opens the lid assembly 100.

However, the present invention is not limited to the above-mentioned hinges. The hinge unit may also include various devices or parts which may control the rotation angle or rotation speed.

Referring to FIG. 12, a plurality of ribs are provided at a lower surface of the first, second, third, and fourth lid inners 141, 142, 143, and 144.

A glass guide rib 140*a* protrudes from a lower surface of each of the first, second, third, and fourth lid inners 141, 142, 143, and 144 to seat the glass unit 150 thereon.

The glass guide rib 140*a* guides and positions the glass unit 150 upon assembly of the glass unit 150. The protruded glass guide rib 140*a* may also be bent in the shape of "┐". .

The first lid inner 141 and the third lid inner 143 are formed symmetrical to each other, and for purposes of brevity, the description will focus on the third lid inner 143.

A first reinforcing rib 143*a* is formed on a lower surface of the third lid inner 143 to reinforce intensity. The first reinforcing rib 143*a* is longitudinally formed in the front and rear directions. A plurality of first reinforcing ribs 143*a* may be provided in the left and right directions and be spaced apart from each other by a predetermined interval. The first reinforcing rib 143*a* may prevent the third lid inner 143 from being deformed due to a force exerted by the glass unit 150 to the third lid inner 143 when the glass unit 150 is assembled.

An inner downward rib 143*b* protrudes downwards from a lower surface of the third lid inner 143 to be coupled to the lower lid frame 130. A coupling hole 143*c* is also formed on the lower surface of the third lid inner 143 to be coupled to the lower lid frame 130.

Figure 13:
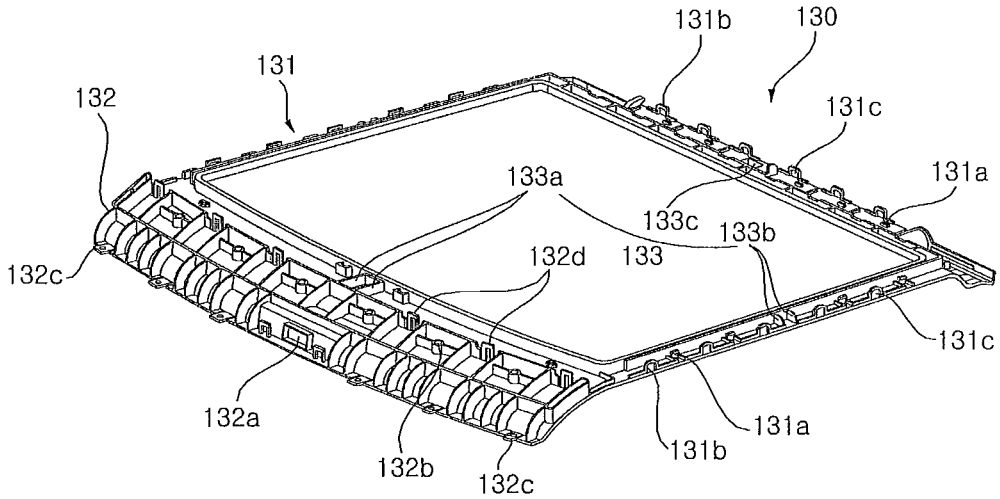
FIG. 13 is a perspective view illustrating the lower lid frame shown in FIG. 3.

Specifically, the inner downward rib 143*b* is coupled to an inner downward rib coupling part 131*a* provided in the lower lid frame 130 as shown in FIG. 13. The inner downward rib coupling part will be described below.

The coupling hole 143*c* is coupled to a frame rib 131*b* provided on the lower lid frame 130 as shown in FIG. 13. The frame rib 131*b* is inserted into the coupling hole 143*c*. A protrusion 143*d* protrudes from a side surface of the coupling hole 143*c* to hook the inserted frame rib 131*b*.

A plurality of inner front protrusions 143*e* spaced apart from each other by a predetermined interval may protrude frontwards from a front surface of the third lid inner. The inner front protrusion 143*e* is coupled to a front protrusion coupling rib 132*d* provided in the lower lid frame 130. The front protrusion coupling rib 132*d* will be described below.

The second lid inner 142 and the fourth lid inner 144 may be formed symmetrical to each other. Accordingly, the description will now focus on the second lid inner 142 for purposes of brevity.

A second reinforcing rib 142*b* is formed on a lower surface of the second lid inner 142 to reinforce intensity. The second reinforcing rib 142*b* is longitudinally formed long in the front and rear directions. A plurality of second reinforcing ribs 142*b* may be provided in the left and right directions to be spaced apart from each other by a predetermined interval. The second reinforcing rib 142*b* may prevent the second lid inner 142 from being deformed due to a force exerted by the glass unit 150 to the second lid inner 142 when the glass unit 150 is assembled.

A coupling hole 142*c* is formed on a lower surface of the second lid inner 142 to be coupled to a frame rib 131*c* provided on the lower lid frame 130 as shown in FIG. 13. The frame rib 131*b* may be inserted into the coupling hole 142*c*. A protrusion 142*d* protrudes from a side surface of the coupling hole 142*c* to hook the inserted frame rib 131*b*.

Figure 14:
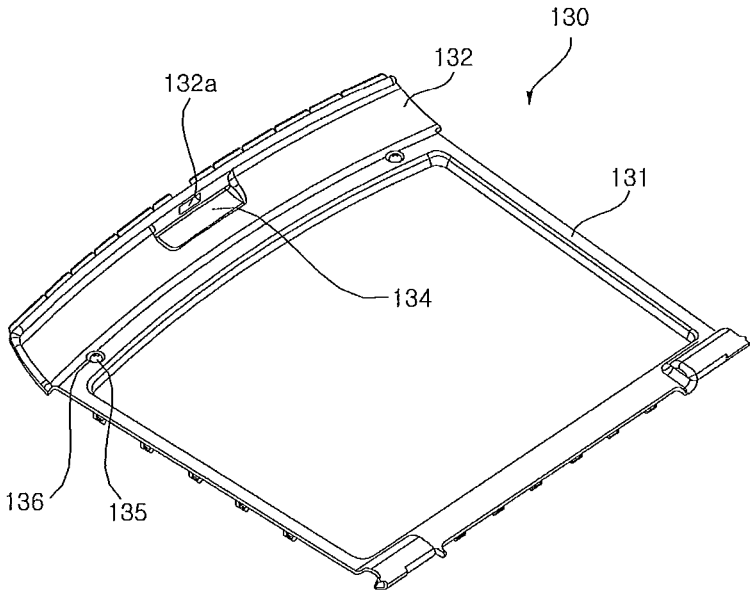
FIG. 14 is a perspective view illustrating the lower surface of the lower lid frame shown in FIG. 13.

FIG. 13 is a perspective view illustrating the lower lid frame shown in FIG. 3, and FIG. 14 is a perspective view illustrating the lower surface of the lower lid frame shown in FIG. 13.

Referring to FIGS. 13 and 14, the lower lid frame 130 includes a frame part 131 which opens at its central portion and a coupling part 132 which extends from a front end of the frame part 131 and is coupled to the upper lid frame 120. The coupling part 132 of the lower lid frame 130 may be formed to be inclined from the frame part 131 by a predetermined angle. The coupling part 132 may include a locking device connecting hole 132*a* for connecting a locking device.

Referring to FIG. 13, the coupling part 132 includes a screw connecting hole 132*b* which corresponds to the screw connecting hole 125 of the upper lid frame 120.

A frame front rib 132*c* protrudes frontwards from a lower end of the coupling part 132 to be coupled to the decoration panel 160.

Figure 16:
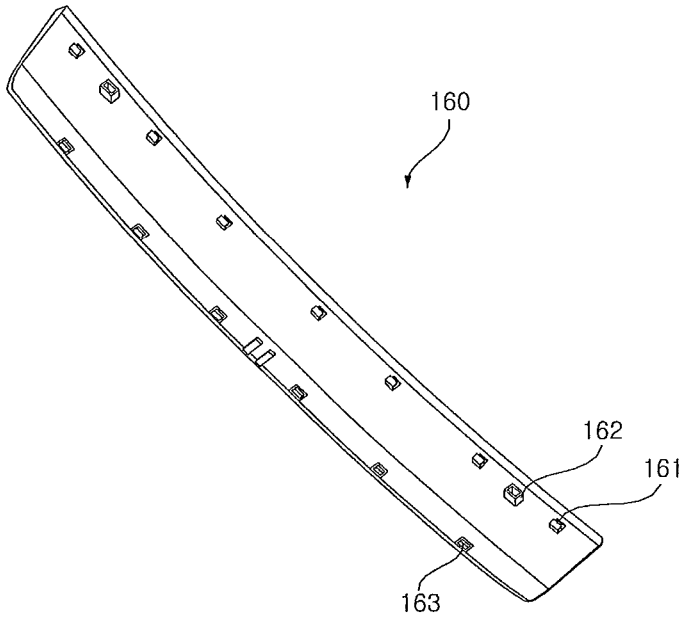
FIG. 16 is a perspective view illustrating a lower surface of the decoration panel shown in FIG. 15.

Specifically, the frame front rib 132*c* is coupled to a decoration panel protrusion 163 as shown in FIG. 16. The decoration panel protrusion 163 will be described below.

The coupling part 132 includes a gap press-fitting part 133 protruded and inserted into the gap between the two adjacent lid inners 140 and pressurizes the lid inners 140 in the direction away from each other so that the lid inners 140 may be brought in tight contact with an inner surface of the lid frame 110.

The gap press-fitting part 133 includes a pair of ribs which protrude upwards from an upper surface of the coupling part 132 and are spaced apart from each other by a predetermined interval. The gap press-fitting part 133 may also be a protrusion having a predetermined thickness. An embodiment will be described where the gap press-fitting part 133 includes a pair of ribs.

The gap press-fitting part 133 includes a front gap press-fitting part 133*a*, a right gap press-fitting part 133*b*, a rear gap press-fitting part 133*c*, and a left gap press-fitting part (not shown). The front gap press-fitting part 133*a* is provided at a front side of the coupling part 132 and inserted into the space between the first lid inner 141 and the third lid inner 143. The right gap press-fitting part 133*b* is provided at a right side of the frame part 131 and inserted into the space between the first lid inner 141 and the second lid inner 142. The rear gap press-fitting part 133*c* is provided at a rear side of the frame part 131 and inserted into the space between the second lid inner 142 and the fourth lid inner 144. The left gap press-fitting part is provided at a left side of the frame part 131 and inserted into the space between the third lid inner 143 and the fourth lid inner 144.

Both ends of the first lid inner 141 are pressurized by the front gap press-fitting part 133*a* and the right gap press-fitting part 133*b* so that the first lid inner 141 is brought in tight contact with a front and right edge in the upper lid frame 120.

Both ends of the third lid inner 143 are pressurized by the front gap press-fitting part 133*a* and the left gap press-fitting part so that the third lid inner 143 is brought in tight contact with a front and left edge in the upper lid frame 120.

Both ends of the second lid inner 142 are pressurized by the right gap press-fitting part 133*b* and the rear gap press-fitting part 133*c* so that the second lid inner 142 is brought in tight contact with a rear and right edge in the upper lid frame 120.

Both ends of the fourth lid inner 144 are pressurized by the rear gap press-fitting part 133*c* and the left gap press-fitting part so that the fourth lid inner 144 is brought in tight contact with a rear and left edge in the upper lid frame 120.

An inner downward rib coupling part 131*a* is provided on the lower lid frame 130 to be coupled to the inner downward rib 143*b*. The inner downward rib coupling part 131*a* will be described below.

A frame rib 131*b* inserted into the coupling hole 143*c* protrudes from an upper surface of the lower lid frame 130. The frame rib 131*b* may be formed at each of left and right edges and the rear edge of the lower lid frame 130. The frame rib 131*b* includes a protrusion hole 131*c* to which the protrusion 143*d* provided on the coupling hole 143*c* may be inserted.

The front protrusion coupling rib 132*d* is formed on an upper surface of the lower lid frame 130 to be coupled to the inner front protrusion 143*e*. The front protrusion coupling rib 132*d* includes an inserting hole to which the inner front protrusion 143*e* may be inserted in the front and rear directions.

Referring to FIG. 14, the lower lid frame 130 forms the appearance of a lower portion of the lid assembly 100.

The lower lid frame 130 may include a handle groove 134 which allows a user to easily hold the lid assembly. According to an embodiment, a handle which will be described below may be only used without the handle groove 134.

A cushion part connecting hole 136 is formed on a lower surface of the lower lid frame 130 to mount a cushion part 135.

Figure 15:
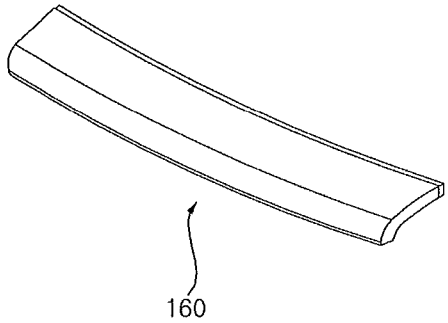
FIG. 15 is a perspective view illustrating the decoration panel shown in FIG. 3.

FIG. 15 is a perspective view illustrating the decoration panel shown in FIG. 3, and FIG. 16 is a perspective view illustrating a lower surface of the decoration panel shown in FIG. 15.

Referring to FIG. 15, the decoration panel 160 is connected by sliding to the upper lid frame 120 coupled to the lower lid frame 130. The decoration panel 160 may be formed to be inclined or bent downwards to correspond to a coupling part of the lower lid frame 130.

Referring to FIG. 16, a decoration panel protrusion 163 is formed on a lower surface of the decoration panel 160 to be coupled to the frame front rib 132*c* of the lower lid frame 130. The decoration panel protrusion 163 is connected to the connecting hole formed on the frame front rib 132*c*.

A plurality of connecting protrusions 161 are formed on a lower surface of the decoration panel 160. Each connecting protrusion 161 may be shaped as the symbol "¬". and is coupled to the connecting protrusion coupling hole 123 formed on the coupling part 122 of the upper lid frame 120.

A plurality of guide protrusions 162 are formed on a lower surface of the decoration panel 160. The guide protrusion 162 is coupled to the guide protrusion coupling hole 124 formed on the coupling part 122 to guide and position the decoration panel 160 upon assembling the decoration panel 160.

Figure 17:
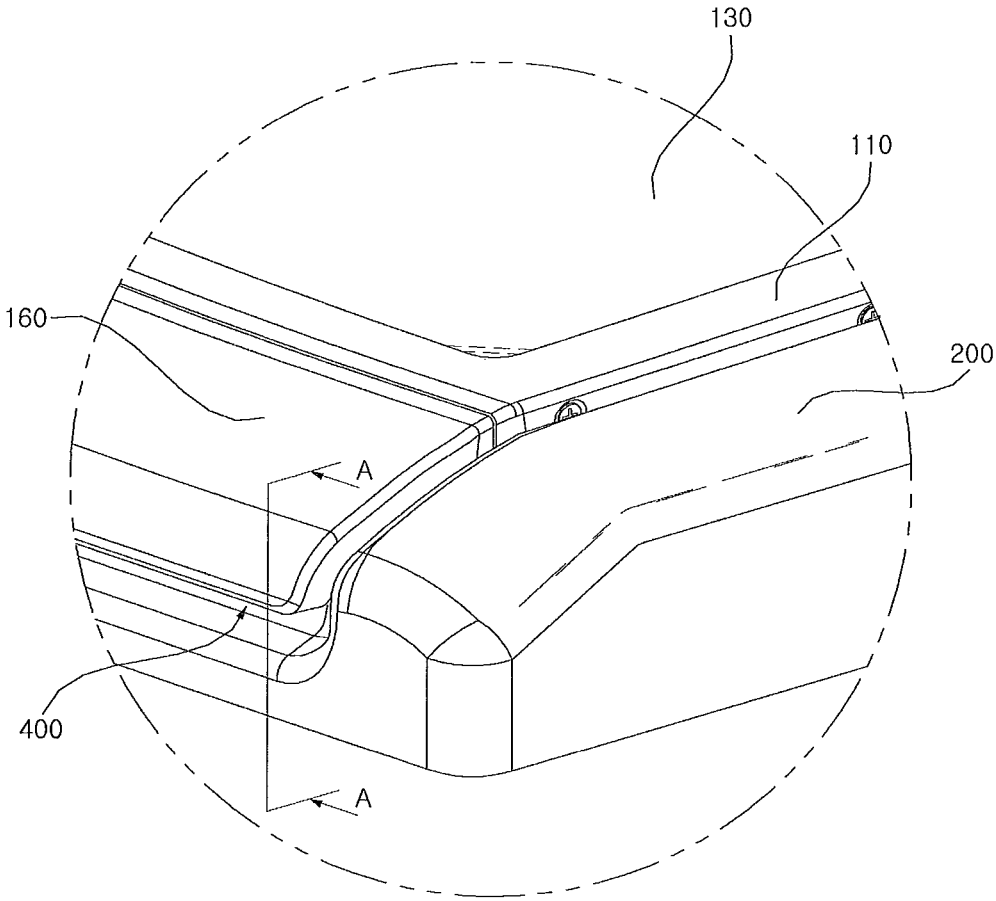
FIG. 17 is an expanded perspective view of part B shown in FIG. 3.
Figure 18:
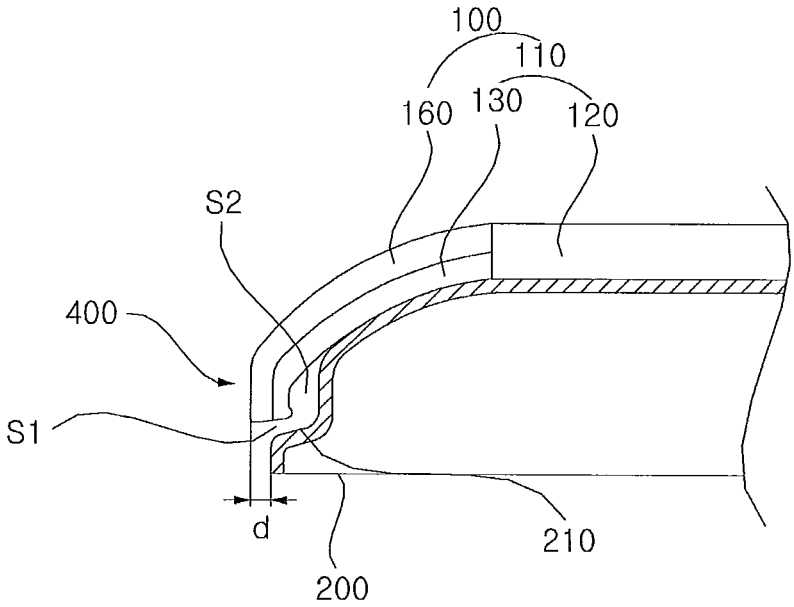
FIG. 18 is a cross sectional view as viewed in the direction of arrow A of FIG. 17.

FIG. 17 is an expanded perspective view of part B shown in FIG. 3, and FIG. 18 is a cross sectional view as viewed in the direction of arrow A of FIG. 17.

Referring to FIGS. 17 and 18, a front end of the lid assembly 100 protrudes more than a front end of the top cover 200, thereby defining a handle 400.

Referring to FIG. 18, a front end of the lid assembly 100 protrudes forwards more than the top cover 200 by a predetermined distance (d) to allow a user to easily hold the handle 400.

The handle 400 and the top cover 200 are spaced apart from each other in the upper and lower directions and in the left and right directions, thereby defining spaces S1 and S2. The spaces S1 and S2 are sized to sufficiently accommodate an adult hand. The space S1 is formed in the upper and lower directions, and the space S2 is formed in the left and right directions.

A user's hand is sequentially inserted into the space S1 and the space S2 so that the user may hold the handle 400 and lift the lid assembly 100.

The spaces S1 and S2 may be formed by a step part 210 provided at a front side of the top cover 200.

The step part 210 is formed by letting a front end of the top cover 200 spaced apart from the handle 400 by a predetermined interval. Each corner of the step part 210 may be rounded.

The handle 400 may be a lower part of a combined structure formed by coupling the lower lid frame 130 with the decoration panel 160. The lower part of the handle 400 may be rounded.

A thickness (t) of the lower part of the handle 400 may be as long as a joint of adult middle finger. For example, the thickness (t) may be in a range from 15 mm to 17 mm. When the thickness (t) is set as above, user's hand may be easily inserted into the spaces S1 and S2.

A process of assembling a lid assembly will be described with reference to FIG. 19.

Figure 19:
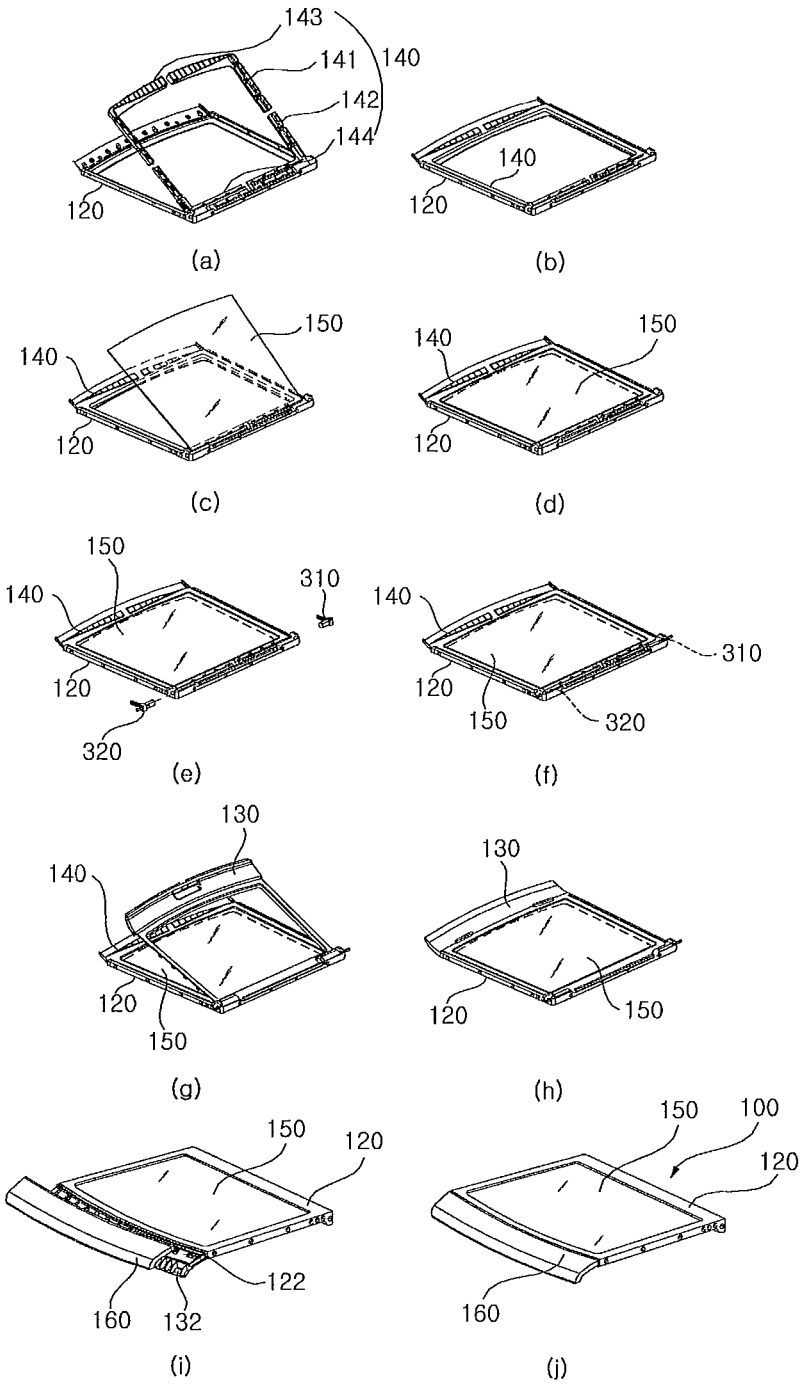
FIG. 19 illustrates a process of assembling the lid assembly shown in FIG. 7.

FIG. 19 illustrates a process of assembling the lid assembly shown in FIG. 7.

Referring to FIGS. 19A and 19B, the upper lid frame 120 is arranged so that the lower surface faces the user.

The first, second, third, and fourth lid inners 141, 142, 143, and 144 are arranged on the lower surface of the upper lid frame 120 so that an end of each lid inner is spaced apart from an end of its adjacent lid inner. Each of the first, second, third, and fourth lid inners 141, 142, 143, and 144 is formed to have the similar shape to each corner of the upper lid frame 120. The first, second, third, and fourth lid inners 141, 142, 143, and 144, are respectively arranged at the corners of the upper lid frame 120.

After completing the arrangement of the first, second, third, and fourth lid inners 141, 142, 143, and 144, the glass unit 150 is assembled.

Referring to FIGS. 19C and 19D, the glass unit 150 is arranged on the first, second, third, and fourth lid inners 141, 142, 143, and 144. The glass unit 150 is guided by the glass guide rib 140*a* for positioning. When a force is exerted onto the glass unit 150 with the glass unit 150 seated on the glass guide rib 140*a*, the first, second, third, and fourth lid inners 141, 142, 143, and 144 are pressurized to be brought in tight contact with four sides of the upper lid frame 120. Each of the first, second, third, and fourth lid inners 141, 142, 143, and 144 is inserted to the lid inner inserting groove 120*a* as shown in FIG. 9 and then brought in tight contact with each corresponding side of the upper lid frame 120. Therefore, the first, second, third, and fourth lid inners 141, 142, 143, and 144 may be securely fixed to the upper lid frame 120.

Referring to FIGS. 19E and 19F, the first hinge unit 310 and the second hinge unit 320 are coupled to the second lid inner 142 and the fourth lid inner 144, respectively. The first hinge unit 310 is inserted to the first hinge unit receiving part 142*a* of the second lid inner 142 as shown in FIG. 10, and the second hinge unit 320 is inserted to the second hinge unit receiving part 144*a* of the fourth lid inner 144 as shown in FIG. 10.

Although it has been described that after the lid inner 140 and the upper lid frame 120 are coupled to each other, the first hinge unit 310 and the second hinge unit 320 are coupled, the present invention is not limited thereto. For example, the second lid inner 142 and the fourth lid inner 144 may be first coupled to the first hinge unit 310 and the second hinge unit 320, and then with the upper lid frame 120.

The hinge axis of the first hinge unit 310 and the hinge axis of the second hinge unit 320 need to be in alignment with each other since the lid assembly may be otherwise twisted when being opened and closed.

To arrange the hinge axes of the first hinge unit 310 and the second hinge unit 320 in alignment with each other, the second lid inner 142 and the fourth lid inner 144 coupled to the first hinge unit 310 and the second hinge unit 320, respectively, are connected to the upper lid frame 120 by a connecting member, such as a screw. For example, the connection may be performed at a position close to the hinge units 310 and 320. As shown in FIG. 9, a side screw connecting hole 121*a* and a rear screw connecting hole 121*b* are formed at the upper lid frame 120 to be screw-connected to the second lid inner 142 and the fourth lid inner 144, respectively.

Although it has been described that the second lid inner 142 and the fourth lid inner 144 are connected to the upper lid frame 120, the second lid inner 142 and the fourth lid inner 144 may be connected to the lower lid frame 130 as well.

After the assembly of the glass unit 150 and the hinge units 310 and 320, the lower lid frame 130 is assembled.

Referring to FIGS. 19G and 19H, the lower lid frame 130 is arranged over the glass unit 150 with the lower surface up. The lower lid frame 130 is coupled to the lid inner 140. Specifically, the inner downward rib 143*b* formed on the lid inner 140 as shown in FIG. 12 is coupled to the inner downward rib coupling part 131*a* formed on the lower lid frame 130 as shown in FIG. 13.

Further, the coupling hole 143*c* formed on the lid inner 140 as shown in FIG. 12 is coupled to the frame rib 131*b* formed on the lower lid frame 130 as shown in FIG. 13.

Further, the inner front protrusions 143*e* formed on the first lid inner 141 and the third lid inner 143 as shown in FIG. 12 is coupled to the front protrusion coupling rib 132*d* formed on the lower lid frame 130.

Accordingly, the lower lid frame 130 and the lid inner 140 may be securely assembled to each other.

Thereafter, as shown in FIG. 19 I, the assembled result shown in FIG. 19H is flipped so that the upper surface of the upper lid frame 120 faces upward.

The upper lid frame 120 and the lower lid frame 130 are connected to each other by a connecting member, such as a screw. Specifically, a connecting member, such as a screw, is inserted into the screw connecting hole 125 formed on the coupling part 122 as shown in FIG. 8 and the front protrusion coupling rib 132*d* formed on the coupling part 132 as shown in FIG. 13. Accordingly, the upper lid frame 120 and the lower lid frame 130 may be securely connected to each other.

Then, as shown in FIGS. 19I and 19J, the decoration panel 160 is coupled to the coupling part 122 of the upper lid frame 120.

For example, the decoration panel 160 may be coupled by sliding to the coupling part 122.

The guide protrusion 162 formed on the decoration panel 160 as shown in FIG. 16 is coupled to the guide protrusion coupling hole 124 formed on the coupling part 122 as shown in FIG. 8.

The connecting protrusion 161 formed on the decoration panel 160 as shown in FIG. 16 is coupled to the connecting protrusion coupling hole 123 formed on the coupling part 122 as shown in FIG. 8.

Since the decoration panel 160 is coupled by sliding to the coupling part 122, the coupling process of the decoration panel 160 may be easily performed.

The invention has been explained above with reference to exemplary embodiments. It will be evident to those skilled in the art that various modifications may be made thereto without departing from the broader spirit and scope of the invention. Further, although the invention has been described in the context its implementation in particular environments and for particular applications, those skilled in the art will recognize that the present invention's usefulness is not limited thereto and that the invention can be beneficially utilized in any number of environments and implementations. The foregoing description and drawings are, accordingly, to be regarded in an illustrative rather than a restrictive sense.

What is claimed is:

1. A washing machine comprising:

a cabinet;

a top cover arranged at an open top surface of the cabinet and having a laundry entrance hole; and a lid assembly disposed to be able to rotate at the top cover and open/close the laundry entrance hole, wherein the lid assembly comprises:

an upper lid frame provided with at least one lid inner inserting groove;

a lower lid frame coupled to the upper lid frame;

a plurality of lid inners which are disposed at each corner of the upper lid frame, respectively, at least one of the lid inners being inserted into the lid inner inserting groove, wherein the plurality of lid inners are spaced apart from each other, and wherein an opening is formed at an inner space surrounded by the plurality of the lid inners;

a glass unit seated at the opening, each corner of the glass unit being surrounded by an inner side of the lid inners, and the glass unit pressing the lid inners toward the lid inner inserting groove such that an outer side of the lid inners is brought in tight contact with the lid inner inserting groove; and a gap press-fitting part protruded from the lower lid frame, the gap press-fitting part inserted into a gap between neighboring lid inners and pressurizing the neighboring lid inners in a direction away from each other.

2. The washing machine of claim 1, the washing machine further comprising:

at least one hinge unit connecting the lid assembly and the top cover such that the lid assembly is rotated, wherein an inner surface of the laundry entrance hole is provided with a hinge receiving part which forms a hole extending in a longitudinal direction of the hinge unit and the hinge unit is inserted into the hole.

3. The washing machine of claim 2, wherein the at least one hinge unit comprises a first hinge unit which adjusts a degree of rotation of the lid assembly when the lid assembly opens or closes, and a second hinge unit which adjusts rotation speed of the lid assembly when the lid assembly opens or closes.

4. The washing machine of claim 3, wherein the first hinge unit comprises a hydraulic damper filled with a fluid and adjusts rotation speed by a fluid pressure, and the second hinge unit comprises an elastic member which provides an elastic force in a direction which opens the lid assembly.

5. The washing machine of claim 2, wherein at least two or more lid inners having the at least one hinge unit among the plurality of lid inners are arranged at a side of the upper lid frame, and wherein each of the lid inners having the at least one hinge unit are connected to the upper lid frame by a connecting member so that hinge axes of the hinge units connected to neighboring lid inners are in alignment with each other.

6. The washing machine of claim 2, wherein the at least one hinge unit comprises first and second hinge units which are arranged at the lid inners respectively, and wherein the lid inners are connected to the upper lid frame by a connecting member so that a first hinge axis of the first hinge unit is in alignment with a second hinge axis of the second hinge unit.

7. The washing machine of claim 2, wherein the upper lid frame comprises a hinge cover extended and wraps around the at least one hinge unit.

8. The washing machine of claim 2, wherein the at least one hinge unit comprises a housing inserted into one of the lid inners and wraps around a hinge shaft which couples the top cover, and a connecting atm which protrudes from a side of the housing and fits into a side surface of one of the lid inners.

9. The washing machine of claim 8, wherein the lid inners, the connecting arm of the at least one hinge unit, and the upper lid frame are arranged in an order thereof, and then integrally connected to each other by a connecting member.

10. The washing machine of claim 1, wherein the upper lid frame and the lower lid frame are coupled to each other by a connecting member in upper and lower directions.

11. The washing machine of claim 1, wherein the plurality of lid inners comprise four lid inners which are spaced apart from each other, wherein each of the lid inners has a similar shape to that of a corner of the upper lid frame, and wherein two lid inners are arranged at a side of the upper lid frame.

12. The washing machine of claim 1, wherein the gap press-fitting part comprises a plurality of ribs which protrude from the lower lid frame and are spaced apart from each other.

13. The washing machine of claim 1, wherein the lid inners further comprise a glass guide rib which guides the positions of the glass unit.

14. The washing machine of claim 1, further comprising:

a handle which protrudes forwards more than the top cover so that a user's hand is inserted into a space between the lower lid frame and the top cover, wherein the user can hold the handle.

* * * * *